US008960504B2

(12) United States Patent
Benson et al.

(10) Patent No.: US 8,960,504 B2
(45) **Date of Patent: *Feb. 24, 2015**

(54) ACTUATOR FOR A DISPENSING APPARATUS

(75) Inventors: William Mercer Benson, Harrison, OH (US); Andrew William Franckhauser, Batavia, OH (US); Todd Mitchell Day, Bethel, OH (US); Shaun Shang-Yun Chan, Montgomery, OH (US); David Matthew Groh, Lebanon, OH (US); Brian David Andres, Harrison, OH (US); Scott Edward Smith, Cincinnati, OH (US)

(73) Assignee: The Gillette Company, Boston, MA (US)

( * ) Notice: Subject to any disclaimer, the term of this patent is extended or adjusted under 35 U.S.C. 154(b) by 286 days.

This patent is subject to a terminal disclaimer.

(21) Appl. No.: 13/353,892

(22) Filed: Jan. 19, 2012

(65) Prior Publication Data

US 2012/0187154 A1 Jul. 26, 2012

Related U.S. Application Data

(60) Provisional application No. 61/435,146, filed on Jan. 21, 2011, provisional application No. 61/435,153, filed on Jan. 21, 2011.

(51) Int. Cl.
*B65D 83/00* (2006.01)
*B67D 7/58* (2010.01)
(Continued)

(52) U.S. Cl.
CPC ..... *B05B 11/3053* (2013.01); *B05B 11/0043* (2013.01); *B05B 11/3014* (2013.01);
(Continued)

(58) Field of Classification Search
USPC ..... 222/190, 402.12, 402.13, 153.11, 148, 222/375, 321.3, 571, 402.23, 402.24; 239/337, 104, 106, 114, 115, 123
See application file for complete search history.

(56) References Cited

U.S. PATENT DOCUMENTS 2,737,416 A * 3/1956 Behr et al. ..... 239/121
3,680,738 A 8/1972 Vos et al.
(Continued)

FOREIGN PATENT DOCUMENTS

FR 1 506 685 12/1966
FR 2 933 678 1/2010
(Continued)

OTHER PUBLICATIONS

PCT International Search Report dated Mar. 28, 2012.

*Primary Examiner* — Kevin P Shaver
*Assistant Examiner* — Stephanie E Williams
(74) *Attorney, Agent, or Firm* — Jay A. Krebs

(57) ABSTRACT

A dispensing apparatus for containing a pressurized composition, said dispensing apparatus comprising: a reservoir for containing a composition; an actuator head comprising a side wall having an interior surface, said actuator head forming a dispensing orifice through said side wall; a displaceable flow conduit comprising a proximal end in fluid communication with said reservoir and a distal end forming a flow conduit orifice, said distal end being movably engaged with said interior surface of said actuator head; and an intermediate member interposed between said interior surface and said distal end and forming an aperture; and wherein said displaceable flow conduit is biased to an at-rest position and can be movably actuated to at least partially engage said intermediate member in a dispense position, thereby at least partially aligning said dispensing orifice with said flow conduit orifice.

17 Claims, 6 Drawing Sheets

(51) Int. Cl.

| | |
|---|---|
| ***B67D 7/76*** | (2010.01) |
| ***B05B 1/28*** | (2006.01) |
| ***B05B 15/02*** | (2006.01) |
| ***B05B 11/00*** | (2006.01) |
| ***B65D 83/20*** | (2006.01) |
| ***B65D 83/22*** | (2006.01) |
| ***B65D 83/34*** | (2006.01) |
| ***B65D 83/62*** | (2006.01) |
| *B05B 7/00* | (2006.01) |

(52) U.S. Cl.

CPC ..... *B05B11/306* (2013.01); *B05B 11/3094* (2013.01); *B65D 83/205* (2013.01); *B65D 83/206* (2013.01); *B65D 83/22* (2013.01); *B65D 83/345* (2013.01); *B65D 83/62* (2013.01); *B65D 83/625* (2013.01); *B05B 7/0018* (2013.01)

USPC ..... 222/402.12; 222/402.23; 222/190; 222/375; 239/104; 239/106; 239/114

(56) References Cited

U.S. PATENT DOCUMENTS

| | | | | |
|---|---|---|---|---|
| 4,944,458 | A * | 7/1990 | Sassenberg | 239/288.5 |
| 7,036,691 | B2 * | 5/2006 | Nicolas | 222/321.6 |
| 2004/0211791 | A1 * | 10/2004 | Petit et al. | 222/321.3 |
| 2010/0012680 | A1 | 1/2010 | Canfield et al. | |
| 2011/0114759 | A1 | 5/2011 | Schmitz | |

FOREIGN PATENT DOCUMENTS

| | | | |
|---|---|---|---|
| FR | 2933678 | A1 | 1/2010 |
| JP | 09-150855 | A | 6/1997 |
| WO | WO 97/25259 | A1 | 7/1997 |

* cited by examiner

ACTUATOR FOR A DISPENSING APPARATUS

CROSS REFERENCE

This application claims the benefit of U.S. Provisional Application Ser. No. 61/435,146, filed on Jan. 21, 2011, and also claims the benefit of U.S. Provisional Application Ser. No. 61/435,153, filed on Jan. 21, 2011, the contents of both which are incorporated herein by reference.

FIELD OF THE INVENTION

This invention generally relates to dispensing devices for containing compositions under pressure, such as aerosol dispensers for spraying compositions as well as foaming compositions.

BACKGROUND OF THE INVENTION

Pressurized dispensing systems such as aerosols are known to be a useful way to deliver certain compositions. Various types of dispensing systems have been described. See, e.g., U.S. Pat. Nos. 5,560,544; 5,305,930; 7,637,399; 7,464,839; 7,143,959; 6,827,239; 6,695,227; 6,588,631; 6,113,070; 6,338,442; 3,613,728; 3,430,819; 3,257,044; 5,918,782; 6,030,682; 7,143,959; and 5,617,978, U.S. Publ. No. 2002 079679; 2010 0004647; and WO Pubs. 2010/005946; 2007/015665; and 2006/071512. Many pressurized dispensing systems typically release composition when the user actuates the device, thereby allowing a volume of composition to be expelled from a dispensing orifice or nozzle. One problem with pressurized dispensing systems is that the composition contained within the flow path following actuation can undesirably exit the dispensing orifice after use. This can be particularly problematic for aerosols which dispense fluids or gels. Even more problematic is where the fluids or gels contain foaming agents, such as for shaving foams, hair mousses, post foaming shaving gels, and so forth, and/or other volume changing aerosol dispense products.

With foaming compositions, the pressure within the container keeps the composition in a non-foamed state. Once the composition is dispensed from the device, the composition is subjected to atmospheric pressure allowing the blowing agents to cause the composition to foam. Any composition trapped within the flow path would also contain blowing agent. Since the flow path is not maintained under pressure, this trapped volume of composition would eventually begin to foam as any residual pressure built up in the flow path dissipates to reach the environmental pressure around the device. Since the volume of the foam can be many times the volume of the composition in liquid or gel state, the foam would push itself out of the flow path through any dispensing orifice.

Attempts to minimize this problem have been described. For example, US 2009/0230156 discloses a spring loaded piston that opens to release gel upon actuation and shuts/seals the flowpath when the actuator is released. This approach seals the flowpath thereby forming the flowpath into a pressure vessel and maintaining the blowing agent into the liquid state. This system can, however, be cost prohibitive and can be subject to performance issues.

U.S. Pat. No. 7,104,424 B2 discloses a flexible flowpath that shuts the end of the flowpath after actuation and allows the gel remaining in the flowpath to expand and foam but remain contained within the flowpath. These systems, however, may be problematic as foamed composition trapped within the flexible flowpath may remain under pressure, causing the actuator to spit already foamed composition on the next dispensing and potentially dispense the composition in inconsistent physical forms due in part to the collapsing of the flexible flow path. Further, the use of flexible and soft materials, such as thermoplastic elastomer, can be costly and complex to assemble.

In US Publ. No. 2007/0090133 to Macleod et al, discloses an actuator comprising a flow conduit mated with a valve stem which is displaceable. Upon actuation, the flow conduit is displaced out of a closed position and actuates the valve stem. It is alleged that the actuator traps residual foamable composition in the flow conduit between the closed valve and the closure when the actuating pressure is released and the flow conduit and the closer return under the action of the bias to their closed position. This system, however, still requires the composition to gradually break down into smaller volumes of liquid as the trapped propellant evaporates and escapes. As such, drooling can still occur, albeit at a potentially slower rate. Further, this system uses a vertical valve spring which can be costly and the valve seal is located in the vertical flow path portion, leaving any horizontal portions subject to post actuation foaming.

In yet another attempt to minimize this problem is to decrease the volume of composition in the flow path. Although this may reduce the amount of material which can eventually foam within the flow path, drooling can still occur. These and other dispensing systems are known but still suffer from various issues such as undesirable drooling, excessive or under spraying, as well as product clogging at the dispense orifice by dried or crystallized product. The present invention addresses one or more of the issues encountered with current systems.

SUMMARY OF THE INVENTION

One aspect of this invention relates to a dispensing apparatus for containing a pressurized composition. The dispensing apparatus comprises a reservoir for containing a composition, an actuator head comprising a side wall having an interior surface and a dispensing orifice formed through the side wall; a displaceable flow conduit comprising a proximal end in fluid communication with the reservoir and a distal end forming a flow conduit orifice. The distal end is movably engaged with the interior surface of the actuator head. An intermediate member having an aperture extending there through is interposed between the interior surface of the actuator head and the distal end of the displaceable flow conduit. The intermediate member is affixed to either the interior surface or the distal end such that the aperture is aligned with either the dispensing orifice or the flow conduit orifice. The displaceable flow conduit is biased to an at-rest position sealing the flow conduit orifice against either the interior surface or the intermediate member and can be movably actuated to at least partially engage the intermediate member in a dispense position, thereby at least partially aligning the dispensing orifice with the flow conduit orifice through the aperture.

DETAILED DESCRIPTION OF THE INVENTION

Figure 1:
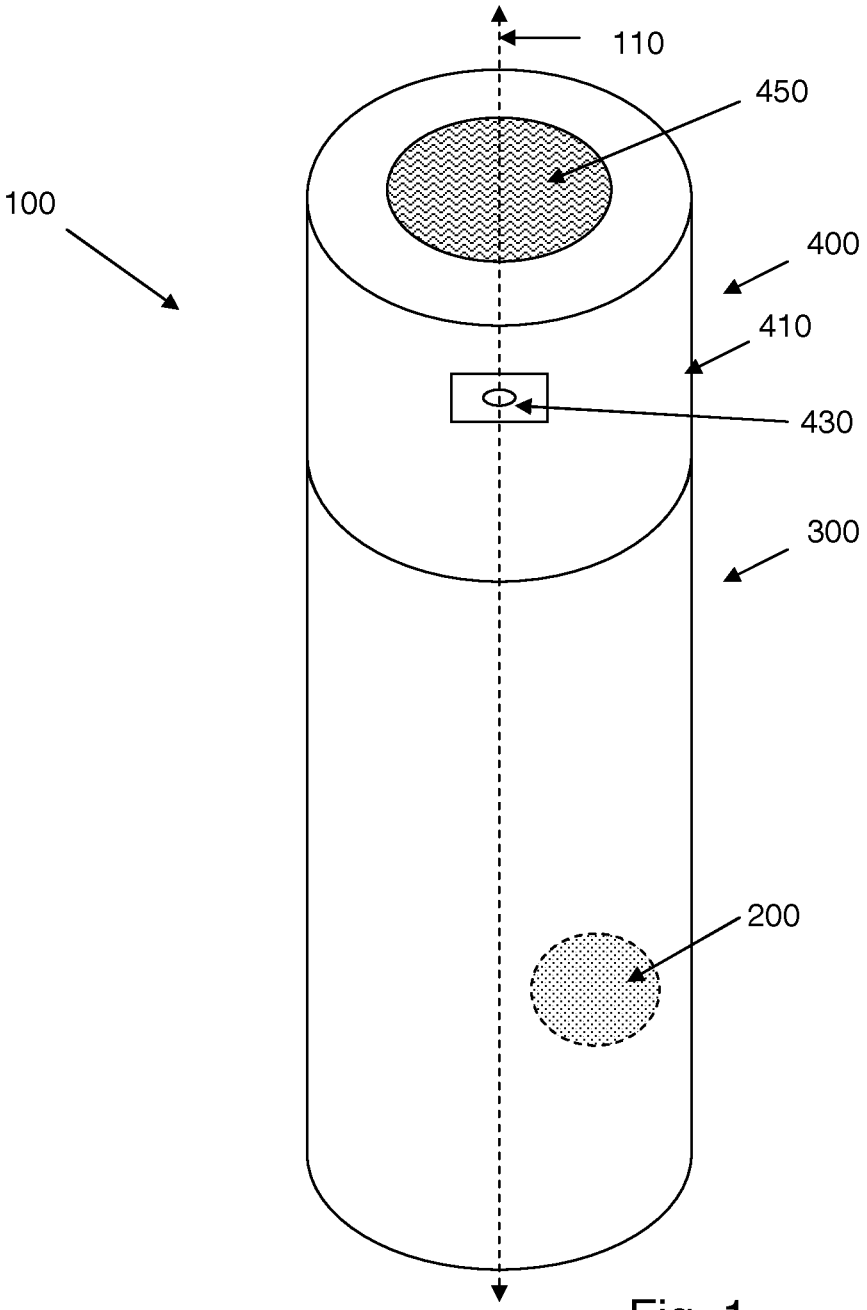
FIG. 1 is a perspective view of a dispensing apparatus in accordance with at least one embodiment of the present invention.

The present invention relates to a dispensing apparatus which addresses one or more of the problems with current product dispensing devices which contain pressurized compositions, such as those disclosed above. It has importantly been found that by providing an intermediate member in combination with various other aspects of the present invention, undesirable drooling of the composition, post actuation, can be minimized while avoiding some of the complex or costly attempts known in the art. In the embodiment of the present invention, the flow conduit is displaceable, allowing at least the distal end to move up and down along the major axis of the apparatus. The actuator head may be stationary. An intermediate member is present between the interior surface and the distal end, and is affixed in this embodiment to the interior surface of the side wall of the actuator head.

I. Dispensing Apparatus a. Actuator

The actuator of the present invention comprises a depressible button and an actuator head. The actuator head comprises a side wall having an interior surface and an external surface, opposite said interior surface. The actuator head forms at least one dispensing orifice through said side wall, from the interior surface to the external surface. The dispensing orifice can have various cross sectional shapes, including but not limited to a circle or oval, a triangle, square or rectangle with rounded or angled edges, or any other suitable geometric shape which can provide desired dispensed composition shapes.

The dispensing orifice can have a constant cross sectional shape, or the cross section can be tapered with the larger cross section being at the interior surface or the external surface. Those of skill in the art will understand that the side wall will typically be curved in the shape of a cylinder wall, as such; measuring cross sectional area of an orifice formed in a curving sidewall can be difficult. To simplify this measurement, the cross sectional area, as defined herein, means the largest planar cross sectional area which can be measured in any orientation within the dispensing orifice. In one embodiment, the dispensing orifice has a diameter from about 0.050 to about 0.1 inches, or from about 0.070 inches to about 0.090 inches, or from about 0.070 inches to about 0.085 inches. The diameter is measured as the greatest linear distance between any two points within the area of the dispensing orifice. In another embodiment, the dispensing orifice has a cross sectional area of from about 0.002 square inches to about 0.008 square inches, preferably from about 0.003 to about 0.006. Those of skill in the art will understand that multiple dispensing orifices can also be used, such as in a side by side arrangement. Side by side dispensing orifice embodiments can be used with a single flow conduit having one or multiple flow conduit orifice(s) and corresponding apertures in the intermediate member. In another embodiment, the apparatus has multiple flow conduits, and as such multiple flow conduit orifices with corresponding apertures in the intermediate member.

In one embodiment, the actuator comprises a locking mechanism. The locking mechanism can be any locking mechanism known in the industry, including but not limited to rotatable or twist top actuators as disclosed in U.S. Pat. Nos. 3,721,423, 6,758,373 (comprising multiple rotatable collars which rotate relative to one another to lock and unlock), and U.S. Pat. No. 7,222,754; U.S. Publ. Nos. 2007/0039979, 2008/0041889 (comprising a rotatable twist ring being moveably mounted to an actuator base). The locking mechanism can also be a locking member which can be a sliding member which exposes or blocks the actuator button from being positioned to cause product to dispense, see e.g. U.S. Pat. No. 5,649,645. In yet another embodiment, the locking mechanism comprises a pair of corresponding indicia on separate portions of the actuator which can rotate relative to one another to form a locked or unlocked orientation. See, e.g., U.S. Ser. No. 61,349,074 to Floyd et al., filed on May 27, 2010.

In one embodiment depressing said button displaces said displaceable flow conduit. Depressing the button actuates the dispensing apparatus, allowing composition to be dispensed through a device flow path, i.e. from the reservoir, through the flow conduit, and eventually out of the dispensing orifice. Those of skill in the art will understand that depressing the button displaces certain structures within the actuator to allow composition to travel through the device flow path. Details on the movement of structures in the actuator will be discussed in greater detail with respect to movement from the at-rest position to the dispense position in Section (d) of this application.

In one embodiment, the button itself moves when depressed. The button can also comprises a deformable material such as a rubber or silicone contact point, with an underlying structure which can be pressed down during actuation. The deformable material of the button can be desirable if a softer feel and/or a waterproof actuator is desired. By waterproof, it is meant that no water can readily enter the interior of the actuator through any gaps or separations formed between the actuator side wall and the actuator button. Non-limiting examples of suitable depressible actuator buttons and sidewalls (also commonly referred to as a shroud) include those disclosed in U.S. Pat. Nos. 6,405,898; 5,232,127; D349845; and D462009.

b. Flow Conduit

The apparatus comprises a flow conduit allowing composition contained in the reservoir to be transferred to the dispensing orifice. The flow conduit comprising a proximal end in fluid communication with said reservoir and a distal end forming a flow conduit orifice, said distal end being engaged with said interior surface of said actuator side wall, with the intermediate member positioned between the distal end and the interior surface. The engagement of the distal end to the interior surface, as defined herein, means that the distal end (or the lip, explained below) is in contact with the interior surface with at least a portion of the intermediate member layered there between.

At least one of the distal end of the flow conduit and the actuator head is moveably engaged to the other of the distal end of the flow conduit and the actuator head. Moveably engaged, as used herein, means that the structure moves in a lateral direction along the major axis of the apparatus. Those of skill in the art will understand that when referring to the relative movement of the actuator head, it can mean the entire actuator head can move, or that just the actuator side wall moves. Further, depending upon which structure to which the intermediate member is attached, the intermediate member can be attached to a moving structure or a stationary structure. For example, in an embodiment where the distal end moves and the actuator head is stationary, if the intermediate member is affixed to the distal end, it moves with the distal end. If the intermediate member is affixed to the interior surface of the actuator side wall, it would be stationary. This also applies where the distal end is stationary and the actuator head, or its side wall moves.

The moveable relationship of the distal end and the actuator head allows the apparatus to form an at-rest position, where the distal end of the flow conduit and the dispensing orifice are not in fluid communication, and a dispense position where the distal end and the dispensing orifice are at least partially overlapping such that they are in fluid communication. These positions are discussed in more detail below in Section (d).

In one embodiment, the distal end is movably engaged with the actuator head. In one embodiment, the entire flow conduit moves upon depressing of the actuator button.

In another embodiment, the distal end is stationary and the actuator head and/or the actuator side wall moves when the button is depressed.

In one embodiment, the distance that either the distal end moves or the actuator head moves from the at-rest position is from about 0.015 inches to about 0.500 inches, or from about 0.040 to about 0.300 inches, or from about 0.080 inches to about 0.200 inches, or from about 0.100 inches to about 0.160 inches. Those of skill in the art will understand that depending on which of the distal end or the actuator head moves, the movement from at-rest to dispense brings the flow conduit orifice and dispensing orifice towards each other. The distance of this movement need not expose the entire flow conduit orifice to the dispensing orifice, or vice versa, but a partial exposure of the orifii is all that is needed to allow for composition to be dispensed.

In one embodiment, where the apparatus has a displaceable flow conduit, the entire flow conduit can move, or it can be hinged at a region opposite the location of the dispensing orifice. The hinged flow conduit can still allow the distal end and the proximal end to move. With a hinged flow conduit, a downward lateral movement of the button onto the flow conduit of X distance can translate to a greater movement of the distal end, since the hinge acts as a pivot. Those of skill in the art will understand that depending on the relative distance of the hinge point to the point on the flow conduit where force is deliver downwards, to the distance of the hinge point to the distance to the distal end, the distance moved by the distal end can be multiplied. This can be calculated by basic geometry by those of skill in the art. In one embodiment, the distal end moves the same distance as how far the button is depressed. In an embodiment with a hinged flow conduit, the distal end can move up to 4× the distance that the button is depressed, or up to 3×, or up to 2×. In one embodiment, where the flow conduit is stationary and the actuator head moves, the actuator head could be hinged with similar affects and benefits as with the hinged flow conduit.

In one embodiment, the flow conduit comprises at least one horizontal portion and at least one vertical portion. The horizontal portion can extend from the proximal end to a connection point with the vertical portion. The vertical portion would then travel from the connection point to a distal end which is engaged with the intermediate member.

In one embodiment, the distal end of the flow conduit applies a force on the intermediate member, of from about 10 psi to about 300 psi, preferably from about 20 to about 200 psi, more preferably from about 30 psi to about 150 psi. This amount of force can also be applied through the intermediate member onto the interior surface of the side wall. In one embodiment, the amount of force applied between the distal end and the intermediate member is at least about 10 psi greater than the pressure with the reservoir or the flow conduit, preferably at least about 25 psi, more preferably at least about 50 psi, up to about 100 psi. Without intending to be bound by theory, it is believed that such an amount of force is desirable to ensure that composition within the flow conduit does not foam or drool out of the dispensing orifice.

In one embodiment, the distal end forms a lip where the distal end comes into contact with the intermediate member. Preferably, the lip can have a smaller external cross sectional area than the distal end of the flow conduit. By narrowing the external cross sectional area, the lip can be more flexible and form a tighter seal against the intermediate member. In another embodiment, there is no lip and the distal end directly engages the intermediate member. In one embodiment, the internal cross sectional area of the flow conduit remains substantially constant throughout the flow conduit. Substantially constant means that the cross sectional area can vary to a minor degree, such as within 25% of the largest cross sectional area, or within 10%, or within 5%, or within 2%.

Where a lip is provided, the lip can have a thickness of from about 0.010 inches to about 0.060 inches, preferably from about 0.015 inches to about 0.050 inches, more preferably from about 0.020 inches to about 0.040 inches. The thickness of the lip is a measurement of the thickness of the side wall forming the lip. In another embodiment, the lip comprises a varying thickness ranging from about 0.015 inches to about 0.050 inches. In one embodiment, when the lip is in contact with the intermediate member, the lip protrudes into said intermediate member by a distance of from about 0.001 inches to about 0.030 inches, preferably from about 0.01 inches to about 0.025 inches, more preferably from about 0.012 inches to about 0.020 inches.

In another embodiment, the lip comprises a height of about 0.010 inches to about 0.040 inches, preferably about 0.030 inches. The height of the lip is measured as the distance which the external cross sectional area of the distal end begins to decrease to form the external cross sectional area of the lip. In one embodiment, the change in external cross sectional area is gradual, such that the distal end terminates in a tapered shape.

In one embodiment, the flow conduit has a fixed interior volume. In another embodiment, the flow conduit can comprises a flexible portion or chamber which can expand as needed to allow some degree of foaming to occur within the flow conduit. This is not necessary but can be included if desired.

In one embodiment, the apparatus comprises only the valve formed when the device is in an at-rest position (i.e., where the distal end is not aligned with the dispensing orifice formed in the actuator side wall. By minimizing the number of valves in the apparatus, the device is simplified and can be less costly.

c. Intermediate Member

The intermediate member is a relatively thin flat film or laminate layer positioned between the interior surface of the actuator side wall and the distal end of the flow conduit. Those of skill in the art will understand that the intermediate member can be referred to as a gasket or packing material fitted between the interior surface of the actuator side wall and the distal end of the flow conduit. Depending upon which of the interior surface of the side wall and the distal end, the intermediate member is affixed, the intermediate member can have different sizes and shapes.

i. Affixed to the Interior Surface of the Actuator Side Wall

In one embodiment, the intermediate member is affixed to the interior surface and forms an aperture which is aligned with said dispensing orifice. This type of embodiment is shown in greater detail in FIGS. 4 and 5, and 6 and 7 In one embodiment, the intermediate member is permanently affixed to the interior surface of the actuator head, such as by glue bonding or heat bonding. In another embodiment, the intermediate member is removeably layered upon the interior surface but not permanently affixed.

The intermediate member can be formed within the actuator by any suitable process known in the art. In one embodiment, the intermediate member can be formed separately then later assembled or placed into the interior of the actuator. In another embodiment, the intermediate member can be formed within the interior of the actuator via a process known as dual shot injection molding (also known as two color or two component molding). The first shot of the injection molding can create the actuator side walls; the second shot could then use the interior of the actuator to mold the intermediate member. Preferably the intermediate member and the actuator are made of different materials.

Where the intermediate member is affixed to the interior surface, the distal end can be in constant contact with the intermediate member while either the flow conduit or the actuator head moves from the at rest position to the dispense position. In an embodiment where the flow conduit and distal end move, the intermediate member forms an aperture which is fixedly aligned with the dispensing orifice formed in the interior surface of the actuator side wall. Fixedly aligned means that the aperture is constantly aligned with the other structure regardless of whether the apparatus is in an at-rest or dispense position. In the at rest position, the distal end would rest in a position above the portion of the side wall forming the dispensing orifice and the portion of the intermediate member forming the aperture. The distal end would slide downward along the major axis until at least a portion of the flow conduit orifice formed in the flow conduit overlaps with the aperture formed in the intermediate member and the dispensing orifice in the side wall. In another embodiment, the actuator head can be displaceable but still have the intermediate member affixed thereon its interior surface.

ii. Affixed to the Distal End of the Flow Conduit

In another embodiment, the intermediate member is affixed to the lip and/or distal end of the flow conduit and is not affixed or otherwise attached to the interior surface. This type of embodiment is shown in greater detail in FIGS. 8 and 9 and 17 and 18. In one embodiment where the flow conduit and distal end are displaceable, the intermediate member can be a gasket or O-ring optionally having a similar shape to the distal end of the flow candidate. In such an embodiment, the intermediate member allows the distal end to apply a constant pressure against a portion of the interior surface of the actuator side walls. In this embodiment, the intermediate member forms an aperture which is fixedly aligned with the flow conduit orifice. In an at-rest position, both the distal end and the intermediate member are not aligned with the dispensing orifice formed in the side wall of the actuator head. In a dispense position, either the distal end and intermediate member or the actuator or side walls are moved relative to the other such that at least a portion of the flow conduit orifice and aperture overlaps with the dispensing orifice to allow product to be transferred from the reservoir, through the flow conduit past the aperture out to the dispensing orifice. In another embodiment, the actuator head can be displaceable and the intermediate member can still be affixed to the distal end.

In one embodiment, the apparatus comprises multiple intermediate members. One of the intermediate members can be is affixed to the interior surface and another intermediate member can be affixed to the lip and/or distal end of the flow conduit. These intermediate members can be single layers, or multiple layers. Further, the different intermediate members can be made of the same or different materials, or mixtures of materials. They can also have varying thickness. Moreover, the different intermediate members can have differing hardness. Without intending to be bound by theory, it is believed that providing multiple intermediate members can allow for a tighter seal to be formed between the distal end and the interior surface and/or can allow for easier movement between such structures (i.e. by picking combinations of materials which may have more or less friction). In one embodiment, the intermediate member has a flat surface where it contacts the interior surface and/or a flat surface where it contacts the distal end. Other surface treatments can also be suitable.

iii. Intermediate Member Composition

The intermediate member is a comprises a thermoplastic material, preferably selected from a thermoplastic elastomer (TPE), thermoplastic urethane (TPU), a thermoplastic olefin (TPO), a soft thermoplastic polyolefin (e.g., polybutylene), or may be selected from other elastomeric materials, such as ethylenevinylacetate copolymer (EVA), and ethylene propylene rubber (EPR), a silicon, or a mixture thereof. There are six generic classes of TPEs generally considered to exist commercially. They are styrenic block copolymers, polyolefin blends, elastomeric alloys (TPE-v or TPV), thermoplastic polyurethanes, thermoplastic copolyester and thermoplastic polyamides. Examples of TPE products that come from block copolymers group are Styroflex (BASF), Kraton (Shell chemicals), Pellethane, Engage (Dow chemical), Pebax (Arkema), Arnitel (DSM), Hytrel (Du Pont) and more. While there are now many commercial products of elastomer alloy, these include: Dryflex, Mediprene, Santoprene, Geolast (Monsanto), Sarlink (DSM), Forprene, Alcryn (Du Pont), Evoprene (AlphaGary), and TPE HTF8796 (Kriberg).

In order to qualify as a thermoplastic elastomer, a material should have at least three following characteristics: the ability to be stretched to moderate elongations and, upon the removal of stress, return to something close to its original shape; processable as a melt at elevated temperature; and absence of significant creep. Examples of suitable thermoplastic elastomers herein include styrene-ethylene-butadiene-styrene (SEES), styrene-butadiene-styrene (SBS), and styrene-isoprenestyrene (SIS).

Non-limiting examples of suitable thermoplastic olefins herein include polybutylene (PB) and polyethylene (PE)

Non-limiting examples of suitable silicons are those used commercial products such as aerosol dispensers or other household consumer products.

In one embodiment, the intermediate member comprises a material having a durometer of from about 20 to about 60 Shore A hardness, or from about 25 to about 50, or from about 35 to about 40. Without intending to be bound by theory, it is believed that an intermediate member having this degree of hardness allows for a sufficiently strong seal to be formed between the distal end of the flow conduit and the intermediate member such that either the pressure built up within the flow conduit remains substantially constant over time, or that the composition trapped within the flow conduit is not subjected to sufficiently low pressure that it begins to foam. By substantially constant over time, it is meant that the pressure built up within the flow conduit does not decrease by more than about 10%, or about 5%, or about 2%, over a 24 hour period.

In one embodiment, the intermediate member comprises a single layer. The intermediate member can also comprise multiple layers of one or more compositions, laminated upon each other.

In one embodiment, at least one of the interior surface or the intermediate member comprises at least one guiding channel oriented to direct displacement of the flow conduit in a lateral position along a major axis of the apparatus. This can be particularly useful where the actuator or a part thereof is rotatable. The guiding channel ensures that the movement along the guiding channel can only occur in an unlocked position, and where either the distal end or the actuator or side walls are moved in a lateral direction along the major axis.

In another embodiment, at least one of said intermediate member and said interior surface forms a receiving structure adapted to receive said distal end in said dispense position. This helps ensure that the apparatus will not be maneuvered into a configuration beyond the dispense position. As such, in embodiments where the distal end moves, the guiding channel ensures that the distal end has a stopping position so it will not be overly depressed and damage the apparatus. In embodiments where the actuator or side walls move, the guiding channel keeps the actuator or side walls from being moved beyond an acceptable distance from the dispense position.

d. At-Rest and Dispense Positions

The apparatus can be switched from an at-rest position and a dispense position. Preferably the apparatus is biased to an at-rest position. In one embodiment, the at-rest position seals the distal end of the flow conduit against either the interior of the side wall (i.e. where the intermediate member is affixed to the distal end) or against a portion of the intermediate member (where the intermediate member is affixed to the interior of the side wall.

When the user actuates the apparatus, either the distal end or the actuator head are moved relative to one another to at least partially engage the displaceable structure with the other of the distal end or the actuator head to form a dispense position. At least partially engaging, as defined herein means, that at the structures at least partially align such that a flow path is formed allowing composition from the reservoir to be dispensed out the dispensing orifice. At least partially aligned, as defined herein, means that composition can travel out the flow conduit orifice, through the aperture and out the dispensing orifice to be expelled from the apparatus.

In one embodiment, the three displaceable structure fully engages the other structure such that there is a complete alignment of the holes formed in the structures. In one embodiment, all three are aligned such that there is a complete overlap of their cross sectional shapes (i.e. they form concentric or overlapping holes). The holes can all be the same size or can have varying sizes, with the largest being any of the three. In one embodiment, the dispensing orifice has the largest area, followed by the aperture, followed by the flow conduit orifice. In one embodiment, the aperture has the same area as either or both of the dispensing orifice and the flow conduit orifice. The dispense position can expose at least 5% of the dispensing orifice to the flow conduit orifice, or from about 25% to about 100%, or from about 50% to about 75%. Those of skill in the art will understand that it will be preferable for the aperture not to obscure the orifice formed from the structure it is affixed to.

As explained above, in one embodiment, the button to be placed the top of the actuator head (opposite the portion of the actuator which is contact with the reservoir. In this embodiment, the button is depressed along a major axis of the apparatus, towards the reservoir. Depressing the button can displace the flow conduit, allowing it to slide or travel along the major axis.

e. Components between the Proximal end of Flow Conduit and Reservoir

The apparatus can further comprise components between the proximal end of the flow conduit and the reservoir. These components are available in commercially available dispensing apparati such as side dispensing aerosols which dispense product in a vertical direction away (i.e. post foaming shave gels) and top dispensing aerosols which dispense product along the major axis in a horizontal direction (i.e., hair mousse dispensers).

In one embodiment, the apparatus further comprises a valve stem positioned between said proximal end and said reservoir, wherein said flow conduit is further biased to apply a force on the valve stem. The valve stem connects the composition contained within the reservoir to the flow conduit. In one embodiment, the valve stem further comprises a spring, said spring biasing the valve stem into a closed position by applying a force on the valve stem. This biasing force can push the valve stem upwards towards the proximal end of the flow conduit and or another gasket or ring to form a seal. In one embodiment, the same spring can further bias the flow conduit or the actuator away from the reservoir and into the at-rest position. Depressing the flow conduit or the actuator would thereby put the device into a dispense position.

In one embodiment, the spring generated force applied upon the valve stem is less then the force between the displaceable flow conduit and intermediate member. This can be particularly useful so that if a failure point does occur somewhere along the flow conduit or at an interface between the flow conduit and another structure (such as the intermediate member or the valve stem), the weaker seal between the proximal end and the valve stem would be more likely to fail than the seal between the distal end and the intermediate member. Thus, if composition were to leak, it would more likely leak within the apparatus and not out of the dispensing orifice. As such, any composition leakage or drool would be obscured and not make a mess on the exterior of the actuator or rest of the apparatus. In one embodiment, the force upon the valve stem is at least 10 psi to about 100 psi less than the force between the displaceable flow conduit and intermediate member, preferably from about 20 psi to 50 psi.

In one embodiment, the apparatus further comprises an overflow well in fluid communication with the valve stem. This overflow well can preferably be present within the interior of the actuator. This way, if product were to leak or drool, the composition would collect in the overflow well and be less likely to leak out.

f. Reservoir

The reservoir, as defined herein, may include the rest of the apparatus body aside from the actuator, intermediate member and flow conduit. The reservoir comprises a plastic or metal housing, such as those commercially available. The reservoir further comprises a bag, at least partially contained within the housing; the bag contains the composition to be dispensed and is pressurizable via mechanical or chemical means. Non-limiting examples of means to pressurize the composition within the bag include collapsible tubes, pump or squeeze containers, and aerosol-type dispensers, particularly those with a barrier to separate any post foaming gel composition from the propellant required for expulsion, the propellant can be any pressurizable gas commonly used, such as air, hydrocarbons like butane, or nitrogen.

The latter type of dispensers include: (1) mechanically pressurized bag-in-sleeve systems in which a thin-walled inner bag containing the product is surrounded by an outer elastic sleeve that is expanded during the product filling process and provides dispensing power to expel the product (e.g., the ATMOS System available commercially from the Exxel Container Co.); (2) (a) a container preform comprising a polymeric preform and an elastically deformable band surrounding at least a portion of the polymeric perform such as described in U.S. 2009/0263174 to Chan et al; (3) manually activated air pump spray devices in which a pump system is integrated into the container to allow the user to pressurize the container with air in order to expel the product (e.g., the "AIRSPRAY" system available from Airspray International); (4) piston barrier systems in which the product is separated from the driving means by a tight-fitting piston which seals to the side of the container and may be driven by a spring under tension, by a vacuum on the product side of the piston, by finger pressure, by gas pressure to the piston, or by a variety of other means known to the packaging industry; and (5) bag-in-can (SEPRO) systems in which the product is contained in a flexible bag within a can, with a suitable propellant injected into the space between the can and the flexible bag. It is preferred to protect the composition from oxidation and heavy metal contamination. This can be achieved, for example, by purging the composition and container with nitrogen to remove oxygen and by utilizing inert containers (e.g., plastic bottles or bags, aluminum cans or polymer coated or lined cans).

Those of skill in the art will understand that the apparatus can also include commonly used elements such as tubes, valves, springs, etc to allow fluid to be transported from the reservoir through the apparatus out of a dispensing orifice.

II. Composition

As explained above, the device can be used for dispensing various types of particles and fluids. In one embodiment, the device is an aerosol dispenser. Suitable compositions for use in an aerosol will be recognized by those of skill in the art and non-limiting examples include, personal care compositions such as: shave foams, post foaming shave gels, cleaning aerosols, deodorants, sun screens, lotions, hair care products such as conditioners or foams, skin care treatments, fragrances and so forth; and household products such as: air fresheners, hard surface cleaners, insect repellants, fragrances, cooking oils sprays, paints, and so forth. The device can also be a non-aerosol dispensing device such as a pump spray. Various types of pump sprays are known and can be used in accordance with the present invention. Further, the device can be used to dispense any fluid composition which is typically dispensed in pump sprayers. Preferably, the composition is a foaming or post foaming composition.

In one embodiment, the device is used for dispensing a hair removal preparation such as a post foaming shave gel. The composition may be formulated as an aerosol foam, a post-foaming gel (which is the preferred form) or a non-aerosol gel or lather.

In one embodiment, the composition is not a foaming composition. Other suitable compositions include spray deodorants/antiperspirants, air fresheners, hard surface cleaners, cooling sprays and oils, air fresheners, skin and/or hair care compositions, sun screen or tanning sprays, fragrances, paints, and so forth. Without intending to be bound by theory, it is believed that the present invention can decrease the occurrence of crystallization in the dispense orifice or portion of the flow conduit when using these types of compositions. When dispensing these types of compositions the distal end of the flow conduit can be adapted with an atomizer to help particulize the composition as it is dispensed out of the apparatus. Various attachments or nozzles/heads can be placed external to the side wall such that the trajectory of any composition dispensing out of the dispensing orifice can be manipulated. Non-limiting examples of suitable atomizer nozzles include those disclosed in U.S. Pat. Nos. 5,711,488, 5,385,303, and 5,560,444.

III. Details on the Figures

Various embodiments of the present invention are shown in the Figs.

FIG. 1 is a perspective view of a dispensing apparatus 100 comprising an actuator head 400 comprising a side wall 410 and a button 450. The side wall 410 has an interior surface 420 (not shown in this figure). The actuator head 400 sits atop a reservoir 300 for containing a composition 200. The reservoir comprises a bag containing a product, preferably under pressure, and an exterior shell which can be made of various materials such as plastic or metals like tin or aluminum. The actuator head forms a dispensing orifice 430 through said side wall. The dispensing apparatus also has a major axis 110.

Figure 2:
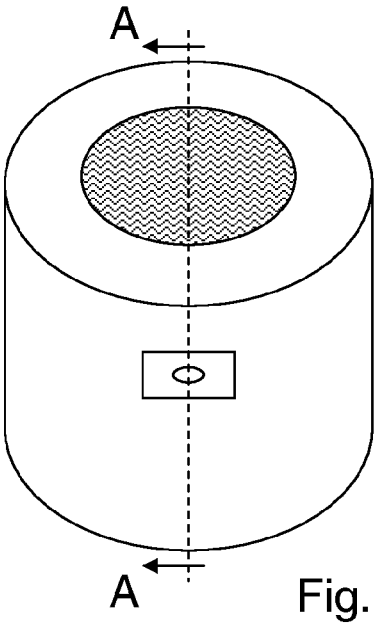
FIG. 2 is a perspective view of the exterior of an actuator head in accordance with at least one embodiment of the present invention. View line A-A is shown as a vertical cut through the center of the actuator head intersecting the dispensing orifice.

FIG. 2 is a perspective view of the exterior of an actuator head in accordance with at least one embodiment of the present invention. View line A-A is shown as a vertical cut through the center of the actuator head intersecting the dispensing orifice. This cross sectional view will be used for various embodiments of the present invention as shown in several of the following figures.

Figure 3:
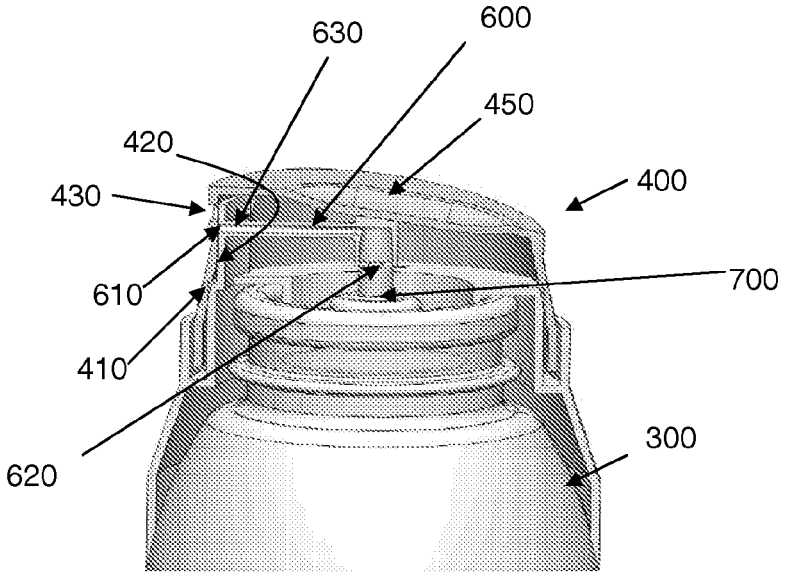
FIG. 3 is a cross sectional view of another dispensing system of the present invention, showing the actuator head and a portion of the reservoir.

FIG. 3 is a cross sectional view of another dispensing system of the present invention, showing the actuator head 400 and a portion of the reservoir 300. An intermediate member 500 (not shown) is positioned on said interior surface 420 and forms an aperture 510 (not shown) which is aligned with said dispensing orifice 430. The flow conduit 600 comprises a proximal end 620 in fluid communication with composition contained within the reservoir 300 and a distal end 630 forming a flow conduit orifice 610. The distal end of this embodiment is movably engaged with said interior surface of said actuator head, wherein the intermediate member is positioned between the distal end and the interior surface. The displaceable flow conduit is biased to an at-rest position and can be movably actuated to at least partially engage said intermediate member in a dispense position by depressing the button 450. The at-rest position is such that the distal end of the flow conduit applies a pressure against a portion of the intermediate member, thereby forming a seal sufficiently strong to control dispensing of product and/or foaming of any residual product within the flow conduit. The dispense position is such that the flow conduit orifice 610 at least partially aligns with said dispensing orifice 430 and said aperture 510. FIG. 3 also shows a valve stem 700 positioned between said proximal end 620 and said reservoir 300.

Figure 4:
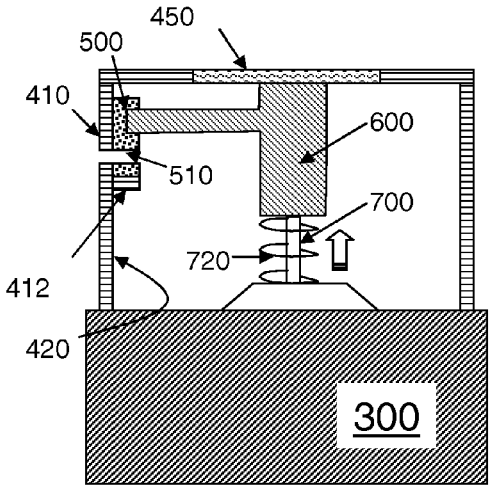
FIGS. 4 and 5 show another embodiment of the present invention where the device is in an at-rest position (FIG. 4) and a dispense position (FIG. 5).
Figure 5:
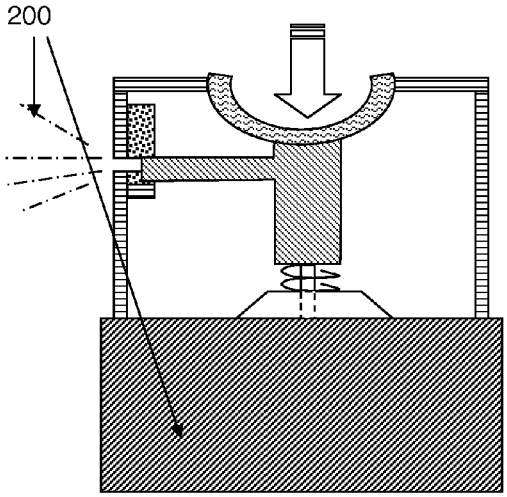

FIGS. 4 and 5 show another embodiment of the present invention where the device is in an at-rest position (FIG. 4) and a dispense position (FIG. 5). An intermediate member 500 is positioned on said interior surface 420 and forms an aperture 510 which is aligned with said dispensing orifice 430. A spring 720 is present on valve stem 700, biasing the flow conduit 600 upwards, away from the reservoir and towards the underbelly of the button 450. In this embodiment, the flow conduit 600 is displaceable. In this embodiment, the flow conduit is displaceable relative to the actuator 400. FIG. 4 shows the interior surface 420 of the side wall 410 forming a receiving structure 412, adapted to receive the distal end of the flow conduit in a dispense position. By providing a receiving structure, the apparatus stops the user from excessively pressing the button and thereby, possibly damaging the device. Although not shown, in embodiments where the apparatus comprises an actuator which has a rotating part or side wall, the interior surface of the side wall and/or the intermediate member can form a guiding channel oriented to direct displacement of the displaceable flow conduit in a vertical position during rotation of the actuator side wall. The interior surface and/or intermediate member can also form a guiding channel oriented to direct displacement of the displaceable flow conduit in a lateral position along a major axis of the apparatus along a major axis of the apparatus during transition from at-rest to dispense positions. FIG. 5 shows the same apparatus in a dispense position where composition 200 is transferred from the reservoir out of the dispensing orifice 430. The spring 720 is compressed by the downward movement of the flow conduit. The spring thereby biases the flow conduit 600 back up into an at rest position when the user stops pressing the button.

Figure 6:
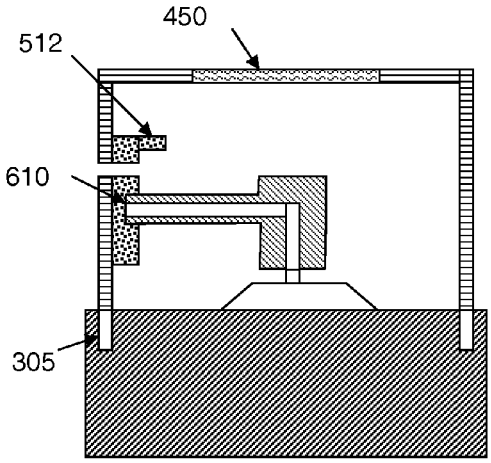
FIGS. 6 and 7 show another embodiment of the present invention in an at-rest position, then a dispense position.
Figure 7:
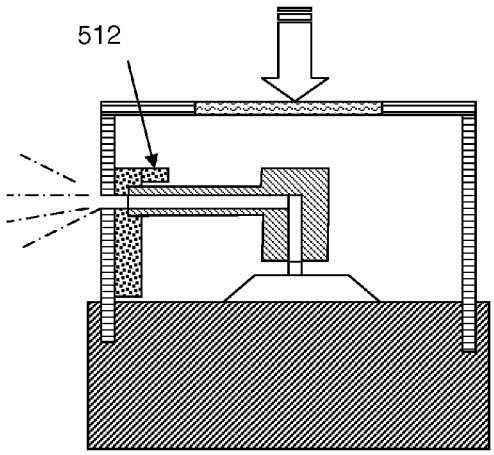

FIGS. 6 and 7 shown another embodiment of the present invention in an at-rest position, then a dispense position. This embodiment is different from the embodiment shown in FIGS. 4 and 5 in that the button need not be flexible but merely allows downward force to be transferred to the actuator head and side walls. Receiving well 305 can be present in the reservoir to allow for downward movement of the side walls. Springs or other biasing members can be loaded into the receiving well to provide a return force. Flow conduit 600 forms a distal end 610 which is in contact and protrudes into intermediate member 500. Intermediate member 500 forms a receiving structure 512 to stop the actuator from moving too far down past the dispense position. Those of skill in the art will appreciate that the distal end (and or its lip) can protrude into said intermediate member by a distance as defined above.

Figure 8:
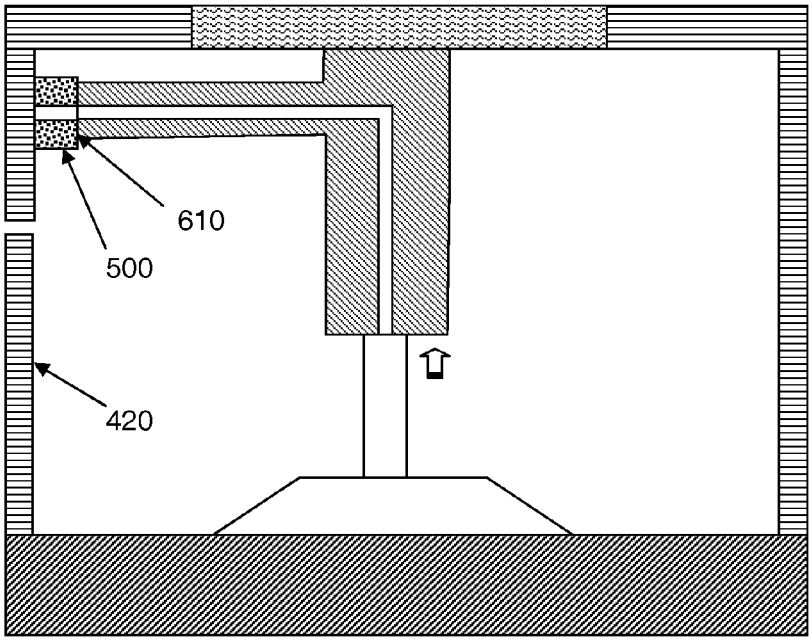
FIGS. 8 and 9 show yet another embodiment of the present invention, switching from an at-rest position to a dispense position.
Figure 9:
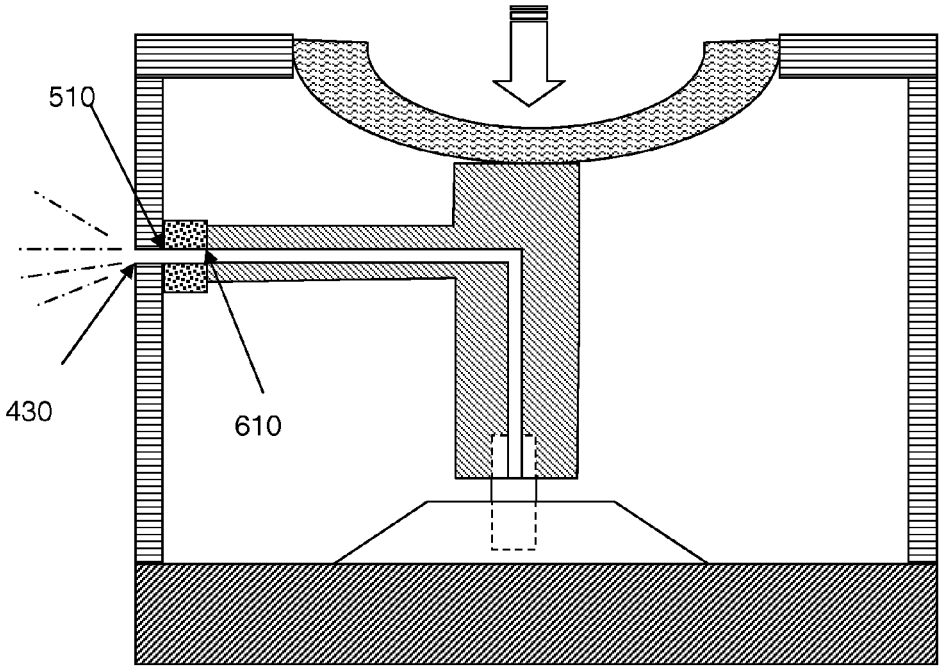

FIGS. 8 and 9 show yet another embodiment of the present invention, switching from an at-rest position to a dispense position. In this embodiment, the intermediate member 500 is affixed to the distal end 630. The intermediate member can slide along the interior surface 420 of the side wall 410 until the apparatus reaches a dispense position, where the aperture 510 in the intermediate member and the flow conduit orifice 610 are at least partially aligned with the dispensing orifice 430. As shown in FIG. 9, upon movement of the flow conduit, the valve stem can also move upwards into the proximal end of the flow conduit, or more preferably downwards towards the reservoir, where the dispense position can also actuate any valve containing pressure and composition within the reservoir. Those of skill in the art will understand that in embodiments where an intermediate member is affixed to the distal end, the actuator can be made to move (similar to as shown in FIGS. 6 and 7) rather than the flow conduit moving.

Figure 10:
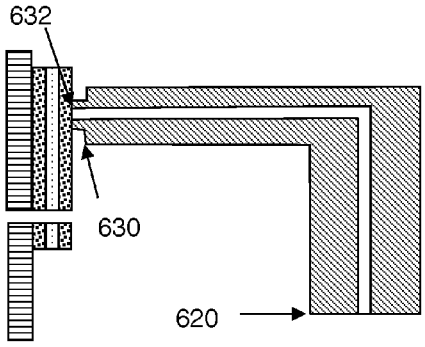
FIGS. 10 and 11 show yet another embodiment of the present invention, switching from an at-rest position to a dispense position.
Figure 11:
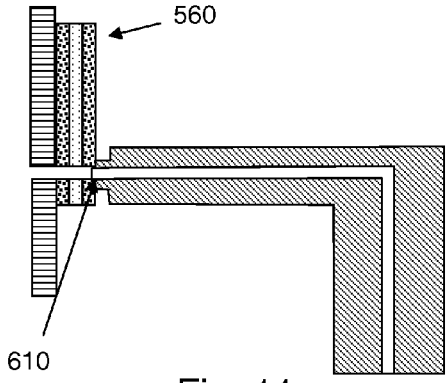

FIGS. 10 and 11 show yet another embodiment of the present invention, switching from an at-rest position to a dispense position. The intermediate member in this embodiment is multiple layers 560, specifically having three layers, wherein the two outer layers could be the same composition and a second composition could be laminated between the outer layers. Those of skill in the art will understand that various compositions can be used to form the various layers and each of the three or however many layers can be different materials having the same or different thicknesses and physical properties, such as hardness. In this embodiment, the distal end 630 is shown forming a lip 632. The lip can have a smaller cross sectional area than the distal end, thereby allowing any pressure applied between the flow conduit to the intermediate member to be concentrated, forming a tighter seal.

Figure 12:
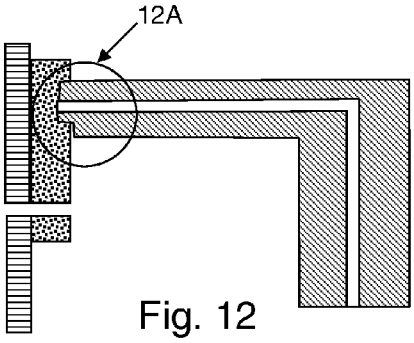
FIG. 12 shows an embodiment, where the lip protrudes into the intermediate member by a distance of up to the height of the lip.
Figure 12A:
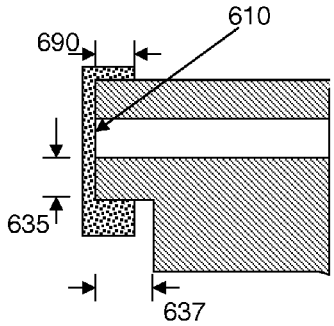
FIG. 12A shows in a blown up view, the lip height and thickness as well as how the distance is measured.

FIG. 12 shows an embodiment, where the lip protrudes into the intermediate member by a distance of up to the height of the lip. In one embodiment the distance is the entire height of the lip, or about 75%, or about 50%, or about 25%. FIG. 12A shows in a blown up view, the lip height 637 and thickness 635 as well as how the distance 690 is measured.

Figure 13:
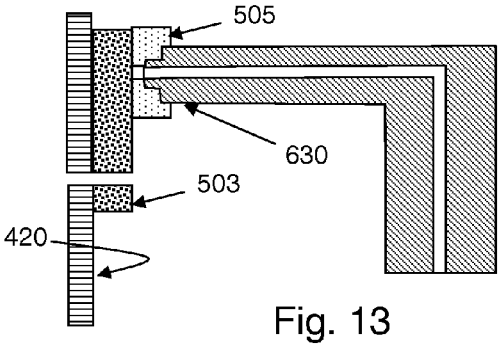
FIG. 13 shows a cross section of another embodiment of the present invention.

FIG. 13 shows yet another embodiment of a dispensing apparatus in accordance with the present invention where multiple intermediate members are provided. In this embodiment, a first intermediate member 503 is affixed to the interior surface 420 of the side wall and a second intermediate member 505 is affixed to the distal end 630. Both intermediate members would have an aperture such that when the apparatus is placed in a dispense position; the apertures at least partially align to allow composition to travel from the interior of the flow conduit out the flow conduit orifice, through each aperture, and eventually out the dispensing orifice.

Figure 14:
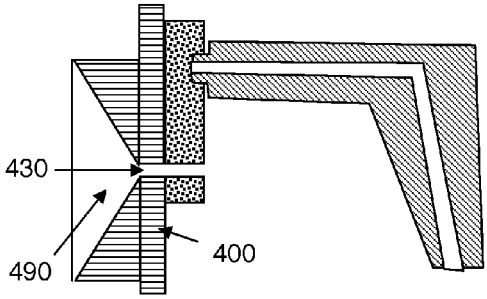
FIG. 14 is yet another cross section of another embodiment of the present invention.

FIG. 14 shows a cross section of an embodiment of the present invention further comprising an atomizer nozzle 490 on the exterior of the side wall 400. The atomizer nozzle allows composition dispensed from the dispensing orifice 430 to become atomized and spray out as particulates. Those of skill in the art will understand that atomizer nozzles can be particularly useful where the composition is desired to dispense in a spraying pattern compared to a shave preps which may be dispensed as a stream of lotion, foam, and/or gel.

Figure 15:
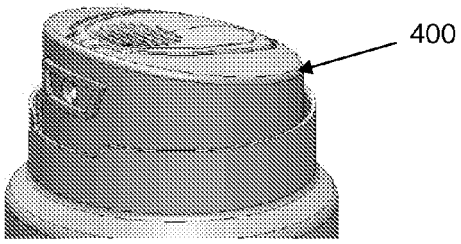
FIG. 15 is a perspective view of another actuator head in accordance with the present invention.
Figure 16:
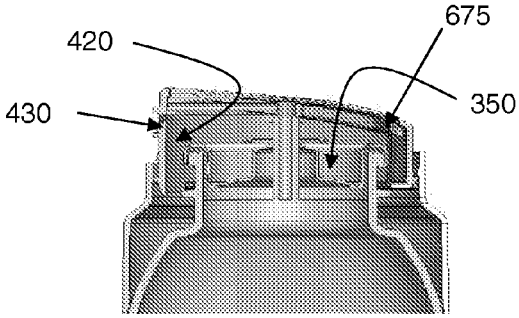
FIG. 16 is a cross sectional view of the actuator of FIG. 15.

FIG. 15 shows a perspective view of another actuator head 400 in accordance with the present invention. FIG. 16 a cross sectional view of the actuator of FIG. 15. A hinge 675 can be positioned on the end of the button, opposite the dispensing orifice. The hinge allows the flow conduit to actuate down but does not require the entire button to move. Also shown in FIG. 16 is an overflow well 350 in fluid communication with the valve stem. As explained above, the benefit of an overflow well within the actuator head is that if one of either the seal between the distal end and the intermediate member or the proximal end and the valve stem were to fail, providing a weaker seal between proximal end and valve stem allows for release of pressure and composition within the flow conduit to be pooled into the overflow well. This can be sightlier and clean as the composition does not escape out the dispensing orifice.

Figure 17:
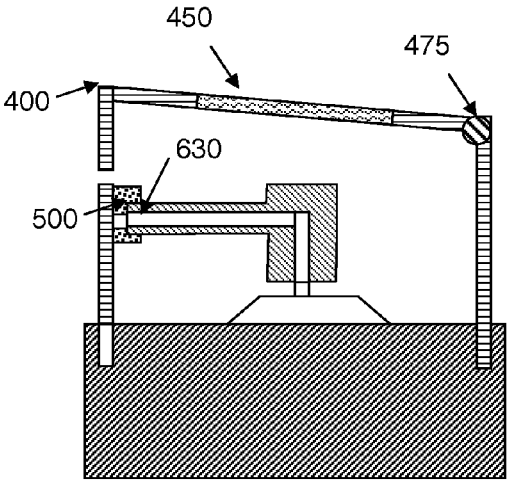
FIGS. 17 and 18 show an embodiment where the intermediate member is affixed to the distal end and the actuator head is displaceable.
Figure 18:
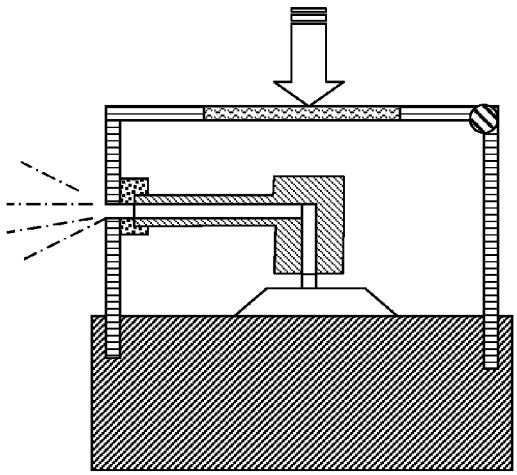

FIGS. 17 and 18 show an embodiment where the intermediate member 500 is affixed to the distal end 630 of the flow conduit and the actuator head 400 is displaceable when a downward force is applied to the button. FIG. 18 shows where the dispensing orifice of the actuator head at least partially aligns with the aperture in the intermediate member and the flow conduit orifice to form a dispense position. In this embodiment, the actuator head has a hinge 675 which allows a portion of the actuator head and side wall to be displaceable.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" All measurements are performed at 25° C., unless otherwise specified.

All documents cited in the DETAILED DESCRIPTION OF THE INVENTION are, in the relevant part, incorporated herein by reference; the citation of any document is not to be construed as an admission that it is prior art with respect to the present invention. To the extent that any meaning or definition of a term or in this written document conflicts with any meaning or definition in a document incorporated by reference, the meaning or definition assigned to the term in this written document shall govern. Except as otherwise noted, the articles "a," "an," and "the" mean "one or more."

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dispensing apparatus (100) for containing a pressurized composition (200), the dispensing apparatus comprising:

a. a reservoir (300) for containing a composition;

b. an actuator head (400) comprising a side wall (410) having an interior surface (420) the actuator head forming a dispensing orifice (430) through the side wall (410);

c. a displaceable flow conduit (600) comprising a proximal end (620) in fluid communication with the reservoir (300) and a distal end (630) forming a flow conduit orifice (610), the distal end (630) is moveably engaged with the interior surface (420) of the actuator head (400);

d. a valve stem (700) positioned between the proximal end (620) and the reservoir (300), the valve stem (700) further comprises a spring (720) biasing the valve stem (700) into a closed position and biasing the distal end (630) of the displaceable flow conduit (600) into an at-rest position; and e. an intermediate member (500) interposed between the interior surface (420) and the distal end (630) having an aperture (510) extending there through, the intermediate member (500) is affixed to either the interior surface (420) aligning the aperture (510) with the dispensing orifice (430) or to the distal end (630) aligning the aperture (510) with the flow conduit orifice (610);

wherein the displaceable flow conduit (600) is biased to the at-rest position sealing the flow conduit orifice (610) against either the interior surface (420) or the intermediate member (500) and wherein the displaceable flow conduit (600) can be movably actuated to at least partially engage the intermediate member (500) in a dispense position thereby at least partially aligning the flow conduit orifice (610) with the dispensing orifice (430) through the aperture (510).

2. The dispensing apparatus of claim 1, wherein the displaceable flow conduit (600) applies a force on the intermediate member (500), of from about 10 psi to 300 psi.

3. The dispensing apparatus of claim 1, wherein the intermediate member (500) comprises a thermoplastic material, selected from TPE, silicon, or a mixture thereof.

4. The dispensing apparatus of claim 1, wherein the intermediate member (500) comprises multiple layers (560).

5. The dispensing apparatus of claim 1, wherein the intermediate member (500) comprises a material having a durometer of from about 20 Shore A hardness to about 60 Shore A hardness.

6. The dispensing apparatus of claim 1, wherein the distal end (630) comprises a lip (632) having a thickness (635) of from about 0.010 inches to about 0.060 inches.

7. The dispensing apparatus of claim 6, wherein the lip (630) comprises a thickness ranging from about 0.015 inches to about 0.050 inches.

8. The dispensing apparatus of claim 6, wherein the lip (630) protrudes into the intermediate member (500) by a distance (690) of from about 0.001 inches to about 0.030 inches.

9. The dispensing apparatus of claim 6, wherein the lip (630) comprises a height (637) of about 0.010 inches to about 0.040 inches.

10. The dispensing apparatus of claim 1, wherein the biasing force on the valve stem (700) is less than the force between the displaceable flow conduit (600) and the intermediate member (500).

11. The dispensing apparatus of claim 10, wherein the biasing force upon the valve stem (700) is at least 10 psi to about 100 psi less than the force between the displaceable flow conduit (600) and intermediate member (500).

12. The dispensing apparatus of claim 1, further comprising an overflow well (350) in fluid communication with the valve stem (700).

13. The dispensing apparatus of claim 1, wherein the displaceable flow conduit (600) comprises a hinge point.

14. The dispensing apparatus of claim 1, wherein the side wall (410) forms an atomizer nozzle (490).

15. The dispensing apparatus of claim 1, wherein at least one of the intermediate member (500) forms a receiving structure (512) and the side wall (410) forms a receiving structure (412) adapted to receive the distal end (630) in the dispense position.

16. The dispensing apparatus of claim 1, wherein the intermediate member (500) is attached to the interior surface (420) and the aperture (510) is aligned with the dispensing orifice (430).

17. The dispensing apparatus of claim 1, wherein the intermediate member (500) is attached to the distal end (630) of the displaceable flow conduit (600) and the aperture (510) is aligned with the flow conduit orifice (610).

* * * * *